US006640069B2

(12) United States Patent
Kanemoto

(10) Patent No.: US 6,640,069 B2
(45) Date of Patent: Oct. 28, 2003

(54) IMAGE FORMING DEVICE WITH A SUPPORT FOR A PHOTOSENSITIVE BODY

(75) Inventor: Seiichi Kanemoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/103,742

(22) Filed: Mar. 25, 2002

(65) Prior Publication Data

US 2002/0141780 A1 Oct. 3, 2002

(30) Foreign Application Priority Data

Mar. 28, 2001 (JP) ..... 2001-091818

(51) Int. Cl.[7] ..... G03G 15/00; G03G 21/00

(52) U.S. Cl. ..... 399/117; 399/167

(58) Field of Search ..... 399/117, 167, 399/299, 301, 75, 98, 99; 347/138, 152

(56) References Cited

U.S. PATENT DOCUMENTS

| | | | | | |
|---|---|---|---|---|---|
| 3,966,316 | A | * | 6/1976 | Pfeifer et al. | 399/111 |
| 5,386,286 | A | * | 1/1995 | Kinouchi et al. | 399/299 |
| 5,842,086 | A | * | 11/1998 | Honma et al. | 399/117 |
| 6,173,137 | B1 | * | 1/2001 | Zona | 399/99 |
| 6,198,891 | B1 | * | 3/2001 | Ishida et al. | 399/117 |

* cited by examiner

*Primary Examiner*—Joan Pendegrass
(74) *Attorney, Agent, or Firm*—Oliff & Berridge, PLC

(57) ABSTRACT

An image forming device including a photosensitive body and a support. The support supports the photosensitive body in a rotatable condition by supporting the outer peripheral surface of the photosensitive body.

9 Claims, 9 Drawing Sheets

IMAGE FORMING DEVICE WITH A SUPPORT FOR A PHOTOSENSITIVE BODY

BACKGROUND OF THE INVENTION

1. Field of the Invention

The present invention relates to an image forming device such as a color laser printer.

2. Description of the Related Art

A tandem laser printer is one type of laser printer for forming full-color images. One example of a tandem laser printer includes an image forming unit for each color. Each image forming unit includes a developing roller, a photosensitive drum, a charge unit, and an exposure unit. The developing roller, the charge unit, and the exposure unit are disposed in confrontation with the photosensitive drum. The charge unit forms a uniform charge on the surface of the photosensitive drum. The exposure unit selectively exposes portions of the charged surface to form a latent static-electric image on the surface of the photosensitive drum. The developing roller bears toner on its surface and develops the latent static-electric image using the toner.

The visible toner images developed for each color are transferred one at a time in order onto a transfer belt so that a full-color image can be formed at substantially the same speed as a monochrome image.

The photosensitive drums of this tandem laser printer normally include a drum body and support members. The drum body has a hollow tubular shape. The support members are press fitted into the inner periphery surface of the drum body from the axial ends of the drum body. The support member includes a support shaft that is freely rotatably supported, for example by the frame of the image forming device, so that the photosensitive drum is in turn rotatably supported.

SUMMARY OF THE INVENTION

However, with this configuration the photosensitive drum will rotate eccentrically if the support shaft is shifted from the circumferential center of the photosensitive drum. When the photosensitive drum rotates eccentrically, the outer peripheral surface of the photosensitive drum will contact the transfer belt with varying peripheral speed. The different color toner images can be shifted out of place with respect to each other because the outer peripheral surface of the photosensitive drum speeds up and slows down in this manner. For example, if a visual image made from one color of toner is transferred to the transfer belt while the outer peripheral surface of the photosensitive drum moves at a high speed and then a visual toner image made from another color of toner is transferred onto the first color image while the outer peripheral surface of the photosensitive drum moves at a slow speed, then the first color toner image will be shifted from the second color toner image. The images will be shifted from each other if the first image is transferred while the peripheral speed is slow and the second image is transferred while the peripheral speed is fast.

Therefore, the support member must be formed with high precision. However, even if the support member is formed with high precision, the photosensitive drum will rotate eccentrically if the inner peripheral surface of the photosensitive drum is made with poor precision. Unlike the outer peripheral surface of the photosensitive drum, which needs to be formed with extremely high precision in order to form the latent-static-electric images properly on the surface of the photosensitive drum, the inner peripheral surface of the photosensitive drum does not need to be made with high precision. Because the inner peripheral surface of the photosensitive drum is made with poor precision, the support shaft of the support member can be shifted from the circumferential center of the photosensitive drum when the support member is press inserted into the photosensitive drum, so that the photosensitive drum will rotate eccentrically.

On the other hand, if the inner peripheral surface of the photosensitive drum is formed with high precision in order to prevent such shifts between different color images, then the cost of the image forming device will increase greatly.

It is conceivable that the tandem laser printer be designed so that the transfer belt is driven by movement of the photosensitive drums. In this case, the toner images would be transferred onto the transfer belt at the peripheral speed where the photosensitive drums contact the transfer belt. However, if there is variation in the drive force produced by the difference photosensitive drums for driving the transfer belt, then a larger burden will be placed on some photosensitive drums than on others in order to move the transfer belt. As a result, the photosensitive drums would have different peripheral speeds at the exposure position, resulting in latent-static-electric images being defectively formed.

It is an objective of the present invention to overcome the above-described problems and provide an image forming device capable of simply and reliably preventing eccentric rotation of the photosensitive drums so that images can be formed properly.

An image forming device including a photosensitive body and a support. The support supports the photosensitive body in a rotatable condition by supporting the outer peripheral surface of the photosensitive body. With this configuration, the support member supports the photosensitive body at the outer peripheral surface of the photosensitive body. Because the outer peripheral surface of the photosensitive body is formed with extremely high precision, this configuration insures that the photosensitive body will rotate with high precision and without any eccentricity. For this reason, visible images formed on the photosensitive body will transferred from the photosensitive body at a uniform speed. Therefore, eccentric rotation of the photosensitive body can be simply and reliably prevented so that proper images can be formed.

BRIEF DESCRIPTION OF THE DRAWINGS

The above and other objects, features and advantages of the invention will become more apparent from reading the following description of the embodiment taken in connection with the accompanying drawings in which;

FIG. 2 (*b*) is a perspective view showing a process cartridge of the cyan developing process portion of FIG. 2 (*a*);

DETAILED DESCRIPTION OF THE EMBODIMENTS

Next, color laser printers according to different embodiments of the present invention will be described while referring to the attached drawings. Like components of the different embodiments will be provided with the same numbering and their description will be omitted to avoid redundant explanation.

Figure 1:
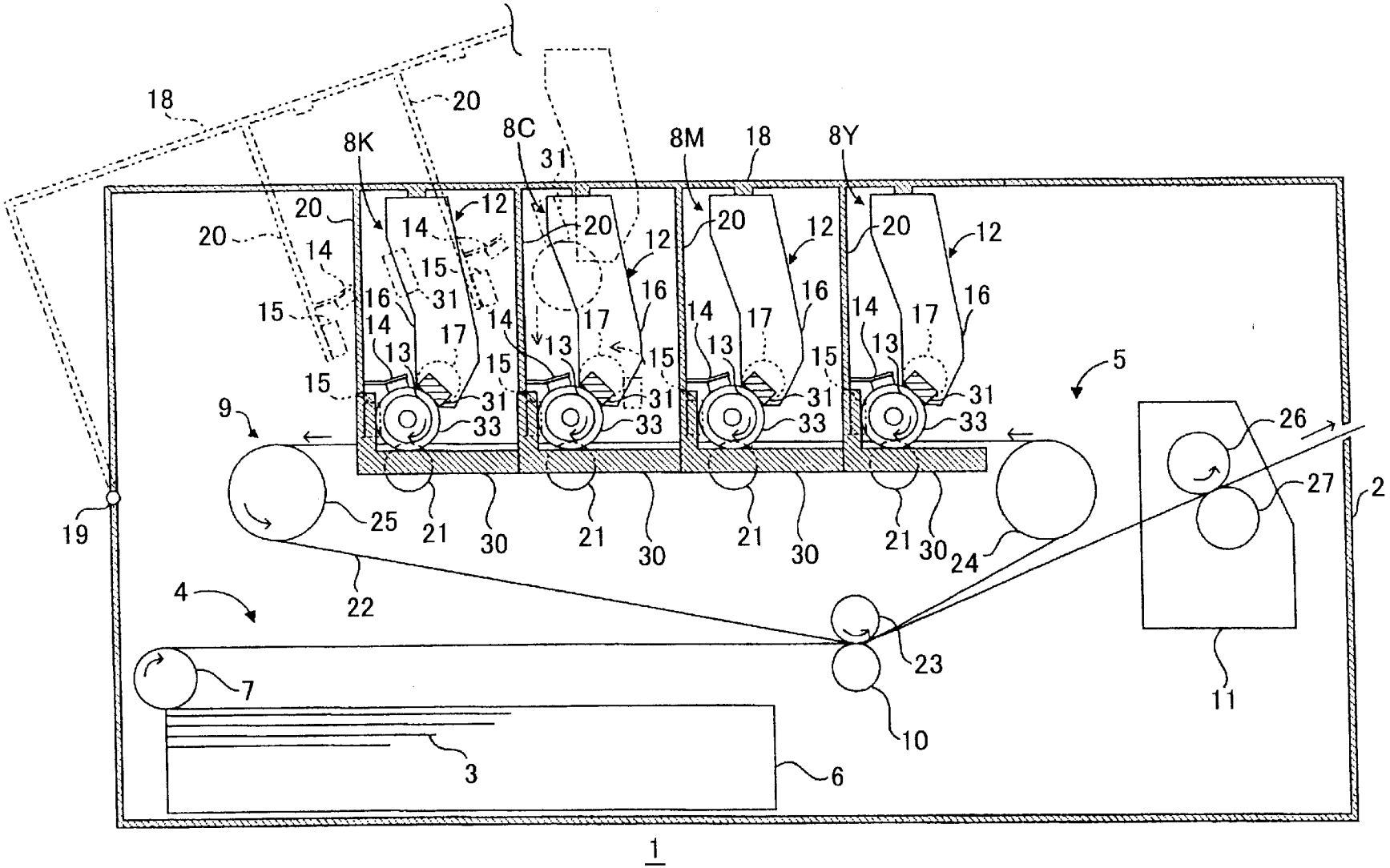
FIG. 1 is a cross-sectional view showing essential components of a color laser printer according to an embodiment of the present invention, wherein the photosensitive drum is supported by an L-shaped member and a stopper member.

First, a color laser printer 1 according to an embodiment of the present invention will be described with reference to FIGS. 1 and 2. As shown in FIG. 1, the laser printer 1 includes a casing 2, an upper cover 18, a sheet-feed portion 4, and an image forming portion 5. The casing 2 houses the sheet-feed portion 4 and the image forming portion 5. The sheet-feed portion 4 is for feeding out sheets 3 one sheet at a time. The image forming portion 5 is for forming images on the fed out sheets 3.

The sheet-feed portion 4 includes a sheet-feed tray 6 and a sheet-feed roller 7. The sheet-feed tray 6 is stacked with sheets 3. The sheet-feed roller 7 feeds out the highest sheet 3 on the sheet-feed tray 6 in order to supply one sheet at a time to the image forming portion 5.

The image forming portion 5 includes four process portion 8*k*, 8C, 8M, and 8Y, an intermediate transfer mechanism 9, primary transfer rollers 21, a secondary transfer roller 10, and a fixing portion 11. The four process portions will be referred to collectively as the "process portions 8" to simplify explanation.

The four process portions 8 include a yellow developing process portion 8Y, a magenta developing process portion 8M, a cyan developing process portion 8C, and a black developing process portion 8K. The four process portions 8 are aligned in the horizontal direction, separated by a predetermined spacing. Each developing process portion 8 has substantially the same configuration and surrounding components, so the configuration of the cyan developing process portion 8C and surrounding components will be described as a representative example.

Figure 2A:
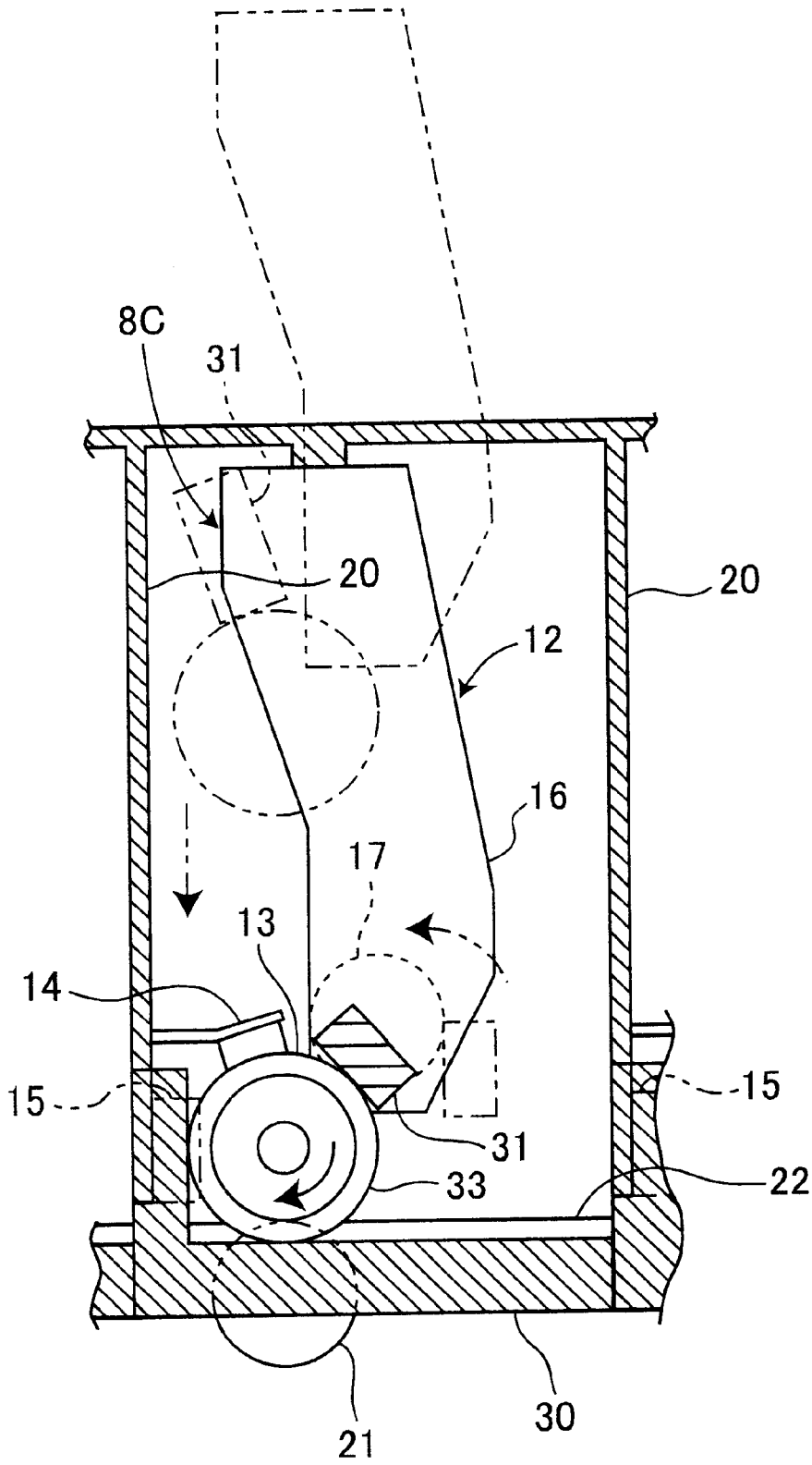
FIG. 2 (*a*) is a magnified view showing a cyan developing process portion as an example of developing process portions in the color laser printer of FIG. 1.
Figure 2B:
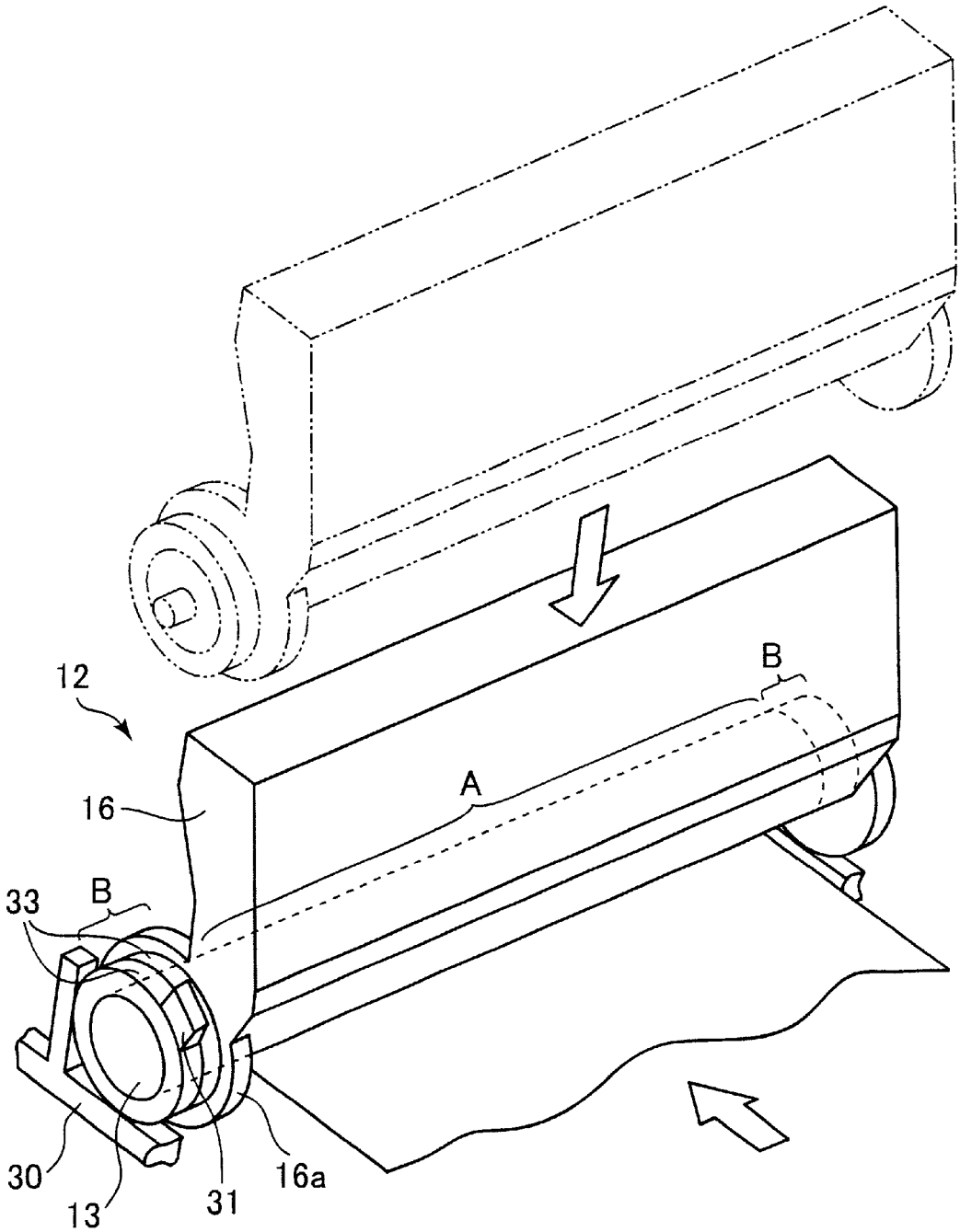

As shown in FIG. 2 (*a*), the cyan developing process portion 8C includes a process cartridge 12, an LED array 14, a scorotron charge unit 15, and a stopper member 31. The process cartridge 12 is freely detachably mounted to the casing 2 as indicated by two-dot chain line in FIGS. 1 and 2 (*b*). As shown in FIGS. 2 (*a*) and 2 (*b*), the process cartridge 12 includes a photosensitive drum 13 and a developing cartridge 16. The developing cartridge 16 is freely detachably mounted with respect to the photosensitive drum 13 in a manner to be described later. The developing cartridge 16 includes a developing roller 17 and, although not shown in the drawings, a layer-thickness regulating blade, a toner-supply roller, and a toner box.

The toner box of the developing cartridge 16 is filled with non-magnetic, single-component toner that charges to a positive charge. Because the cyan developing process portion 8C is being described in this example, the toner box in the developing cartridge 16 is filled with cyan-colored toner. However, the toner box in the developing cartridge 16 of the yellow developing process portion 8Y is filled with yellow-colored toner, the toner box in the developing cartridge 16 of the magenta developing process portion 8M is filled with magenta-colored toner, and the toner box in the developing cartridge 16 of the black developing process portion 8Y is filled with black-colored toner.

The toner-supply roller is rotatably disposed below the toner box. The toner-supply roller includes a metal roller shaft that is covered by a conductive foam roller. The developing roller 17 is rotatably disposed below the toner-supply roller in pressing contact with the toner-supply roller. The developing roller 17 includes a metal roller shaft that is covered by a conductive rubber roller.

The layer-thickness regulating blade is disposed adjacent to the developing roller 17. The layer-thickness regulating blade includes a blade body and a pressing portion. The blade body is made from a metal plate spring and is supported at one end by the developing cartridge 16 at a position near the developing roller 17. The pressing portion is provided on the free end of the blade body, that is, at the end opposite from the end supported by the developing cartridge 16. The pressing portion is made from silicon rubber that has electrically insulating properties and is formed in a half-circle shape when viewed in cross-section. Resilient force of the blade body presses the pressing portion onto the developing roller 17.

Rotation of the toner-supply roller supplies the toner from the toner box to the developing roller 17, where friction between the toner-supply roller and the developing roller 17 charges the toner to a positive charge. As the developing roller 17 rotates, the layer-thickness regulating blade operates to regulate the toner on the developing roller 17 to a fixed thickness and to sufficiently charge the toner.

As shown in FIG. 2 (*a*), the developing cartridge 16 includes attachment members 16*a* that detachably connect to bearing members 33 at axial ends of the photosensitive drum 13. Each attachment member 16*a* has a semi-circular shape with the lower portion (not shown) open. The developing cartridge 16 is mounted on the photosensitive drum 13 by aligning the open portions (not shown) of the attachment members 16*a* with the bearing members 33 and pushing the developing cartridge 16 toward the photosensitive drum 13. The free ends of the attachment members 16*a*, that is, the ends on either side of the open portions, separate because of this pressing force, so that the attachment members 16*a* fit onto the bearing members 33 with a snap. Once the developing cartridge 16 is attached to the photosensitive drum 13, the photosensitive drum 13 is in confrontation with the developing roller 17 from a position below the developing roller 17. It should be noted that the attachment members 16*a* could have the shape of an unbroken circle instead. In this case, the bearing members 33 of the photosensitive drum 13 are passed through the center of the circles to mount the developing cartridge 16 onto the photosensitive drum 13.

The bearing members 33 are ring-shaped roller bearings and one is fitted around the outer peripheral surface at both axial end portions at non-image forming regions B of the photosensitive drum 13. The bearing members 33 enable the photosensitive drum 13 to rotate clockwise as indicated by an arrow in FIG. 1 while being supported by L-shaped members 30 and stopper members 31 to be described later.

The photosensitive drum 13 includes a cylindrical drum body that is connected to ground. The outer circumferential surface of the photosensitive drum 13 is made from an organic photosensitive material including polycarbonate. As shown in FIG. 2 (*b*), an image forming region A is located around the axial central portion of the outer circumferential surface of the photosensitive drum 13. The image forming region A of the photosensitive drum 113 is the region of the photosensitive drum 113 where the sheet intersects the axial direction of the photosensitive drum 113 as the sheet passes between the photosensitive drum 113 and the primary transfer roller 21. Two non-image forming regions B are located at the axial ends of the outer circumferential surface outside from the image forming region A.

The upper cover 18 covers the upper portion of the casing 2. The upper cover 18 is pivotably attached to a side wall of the casing 2 by a hinge 19 so that the upper cover 18 can be opened to attach and remove the process cartridge 12. An attachment frame 20 is provided integrally with the upper cover 18. The attachment frame 20 is attached with the LED array 14, the scorotron charge unit 15, and the stopper member 31.

The LED array 14 is provided above the photosensitive drum 13 and is configured from a plurality of LEDs aligned in a row. The LEDs selectively emit light based on image data to selectively irradiate the surface of the photosensitive drum 13.

The scorotron charge unit 15 is disposed to the side of the photosensitive drum 13 at a position separated from the photosensitive drum 13 so as not to contact the photosensitive drum 13. The scorotron charge unit 15 is a positively-charging scorotron type charge unit that generates a corona discharge from a charge wire made from tungsten, for example. The scorotron charge unit 15 charges the surface of the developing cartridge 16 to a uniform positive charge.

After the scorotron charge unit 15 charges the surface of the photosensitive drum 13 to a uniform positive charge, the LED array 14 emits light based on image data to selectively expose the charged surface of the photosensitive drum 13. The electric potential of the uniform charge on the surface of the photosensitive drum 13 drops where exposed by light from the LED array 14. The portions at the surface with electric potential lowered in this manner form a latent static-electric image.

As mentioned previously, the toner borne on the surface of the developing roller 17 is charged to a positive charge. When the toner on the surface of the developing roller 17 moves into confrontation with the surface of the photosensitive drum 13, the toner is selectively borne on the latent static-electric image, thereby developing the latent static-electric image into a visible toner image. This visible toner forming process is performed separately for each different color the process portions 8K, 8C, 8M, and 8Y. Accordingly, inverse development is achieved for each color.

As shown in FIG. 1, the primary transfer rollers 21 are disposed in the main casing in confrontation with corresponding photosensitive drums 13 and sandwich an endless belt 22 of the intermediate transfer mechanism 9 between themselves and the photosensitive drums 13. As shown in the representative example of FIG. 2 (*a*), each primary transfer roller 21 is located downstream from the corresponding developing roller 17 with respect to the rotational direction of the corresponding photosensitive drum 13. Each primary transfer roller 21 includes a metal roller shaft and a conductive rubber roller. The roller covers the metal shaft. The visible image borne on the photosensitive drum 13 is transferred onto the endless belt 22 as the endless belt 22 passes between the primary transfer roller 21 and the photosensitive drum 13.

As shown in FIG. 1, the intermediate transfer mechanism 9 is disposed in confrontation with all of the photosensitive drums 13 from a position below the photosensitive drama 13. The intermediate transfer mechanism 9 includes the endless belt 22 and three rollers, that is, a first roller 23, a second roller 24, and a third roller 25. The first roller 23 is provided downstream from the sheet-feed roller 7 with respect to the transport direction of sheets 3. The second roller 24 is disposed above the first roller 23 at a position upstream from the yellow developing process unit 8Y with respect to the movement direction of the endless belt 22. The third roller 25 is separated from the second roller 24 by a predetermined distance in the horizontal direction. The third roller 25 is provided downstream from the black developing process unit 8K with respect to the movement direction of the endless belt 22. The first through third rollers 23 to 25 are disposed at the corners of an imaginary inverted triangle. The upper edge of the imaginary triangle is formed by an imaginary horizontal line that connects the upper edges of the second roller 24 and the third roller 25 and passes between the photosensitive drums 13 and the primary transfer rollers 21. Another edge of the imaginary triangle extends diagonally from the second roller 24 to the first roller 23.

The endless belt 22 is wound around the outer periphery of the first through third rollers 23 to 25. The endless belt 22 moves in a direction indicated by arrows in FIG. 1 while sandwiched between the photosensitive drums 13 and corresponding primary transfer rollers 21. It should be noted that the endless belt 22 is made from conductive resin, such as polycarbonate or polyimide, dispersed with conductive particles, such as carbon.

Rotation of the first through third rollers 23 to 25 brings the endless belt 22 sequentially into confrontation with the photosensitive drums 13 so that visible toner images formed in different colors by the different photosensitive drums 13 are transferred onto the endless belt 22 one at a time in order, and overlap to form a full-color image. For example, first a yellow visible image, which was formed on the corresponding photosensitive drum 13 from yellow toner that fills the developing cartridge 16 of the yellow process portion 8Y, is transferred onto the endless belt 22, then a magenta visible image, which was formed on the corresponding photosensitive drum 13 from yellow toner that fills the developing cartridge 16 of the yellow process portion 8Y, is transferred onto the endless belt 22 on top of the previously transferred yellow image. By the same operation, the cyan visible image, which was formed by processes of the cyan developing process unit 8C, and the black visible image, which was formed by processes of the black developing process unit 8K, are also transferred onto the endless belt 22 in an overlapping condition with the yellow visible image and the magenta visible image so that a color image is formed on the endless belt 22.

The secondary transfer roller 10 is rotatably disposed at a position in confrontation with the first roller 23 of the intermediate transfer mechanism 9 through a sheet 3. The secondary roller 10 includes a metal roller shaft and a conductive rubber roller. The roller covers the metal roller shaft. The secondary roller 10 is applied with a predetermined transfer bias. The color image formed on the endless belt 22 is transferred at once onto the sheet 3 passing between the endless belt 22 and the secondary transfer roller 10.

In this way, the visible toner images borne on the different photosensitive drums 13 are temporarily transferred onto the endless belt 22 of the intermediate transfer mechanism 9. After a color image is formed on the endless belt 22 by stacking the different colored images onto the endless belt 22, the full color image is transferred in a single action from the endless belt 22 onto the secondary transfer roller 10.

The fixing portion 11 is disposed downstream from the secondary transfer roller 10 with respect to the transport direction of the sheet 3. The fixing portion 11 includes a thermal roller 26 and a pressing roller 27. The pressing roller 27 presses against the thermal roller 26. The thermal roller 26 is made from metal and includes a halogen lamp for heating the metal. The thermal roller 26 thermally fixes the color image that was transferred by the secondary transfer roller 10 onto the sheet 3 as the sheet 3 passes between the thermal roller 26 and the pressing roller 27. Afterward, the sheet 3 is discharged from the casing 2.

In this way, the color laser printer 1 includes a photosensitive drum 13 for each color so that using a tandem type mechanism a full color image can be formed with substantially the same speed as a monochrome image.

Next, the L-shaped members 30 and the stopper members 31 for supporting the photosensitive drum 13 of the process portion 8C through the bearing member 33 will be described. One of the L-shaped members 30 is disposed at both axial ends of each photosensitive drum 13 in a non-image forming portion of the photosensitive drum 13. The L-shaped members 30 are formed contiguously with each other in confrontation with the photosensitive drums 13 at positions below the photosensitive drums 13. The L-shaped members 30 are fixed to the main casing 2.

The stopper members 31 have a substantial rectangular shape in cross section and are disposed in confrontation with the photosensitive drum 13 at a position that confronts the L-shaped member 30 through each axial directional end portion of the photosensitive drum 13. The stopper members 31 are fixed on the attachment frame 20 of the upper cover 18. As a result, the stopper members 31 move away from the bearing member 33 of the photosensitive drum 13 when the upper cover 18 is opened up, and move into abutment with the bearing member 33 of the photosensitive drum 13 as shown in FIG. 2 (*b*) when the upper cover 18 is closed. To remove the process cartridge 12, the upper cover 18 is opened up so that the stopper members 31 swing in the direction that separates them from the photosensitive drum 13. After the process cartridge 12 is mounted, the upper cover 18 is closed so that the stopper members 31 swing in the direction for pressing against the bearing members 33 that are fitted at either axial end of each photosensitive drum 13. Therefore, while the photosensitive drums 13 are mounted in the printer, each axial end of the photosensitive drums 13 is supported, through the corresponding bearing member 33, by the corresponding L-shaped members 30 from one position below and from one position at the aide and by the corresponding stopper member 31 from one position above.

By supporting the photosensitive drum 13 in this manner, the outer peripheral surface of each photosensitive drum 13 is supported at three positions by the L-shaped member 30 and the stopper member 31 via the bearing member 33. Because the outer peripheral surface of the photosensitive drum 13 is formed with extremely high precision, the photosensitive drum 13 will rotate with proper precision, without any eccentricity. For this reason, all portions of the visible image formed on the surface of the photosensitive drum 13 are transferred with a uniform speed onto the endless belt 22. Therefore, eccentric rotation of the photosensitive drum 13 can be reliably and simply prevented and good images can be formed. As a result, all of the photosensitive drums 13 of the color laser printer 1 contact the endless belt 22 with the same peripheral speed, so that color shifts, which can be caused by variations in peripheral speeds of the different photosensitive drums 13, can be effectively avoided so that high-quality images can be formed.

The photosensitive drum 13 is supported at its outer peripheral surface, which is formed with extremely high precision, at a total of three positions, that is, at two positions by the L-shaped member 30 and at one position by the stopper member 31. Therefore, positioning of the photosensitive drum 13 can be easily and reliably performed. As a result, the photosensitive drum 13 can be reliably supported, so that eccentric rotation can be that much more effectively prevented, and proper images can be formed.

Although the photosensitive drum 13 is driven to rotate, it is rotatably supported on the fixedly provided and stationary L-shaped member 30 and stopper member 31 through the bearing member 33. Therefore, the photosensitive drum 13 can be reliably positioned and rotated using a simple configuration. As a result, eccentric rotation of the photosensitive drum 13 can be reliably prevented and images can be formed properly.

Figure 3:
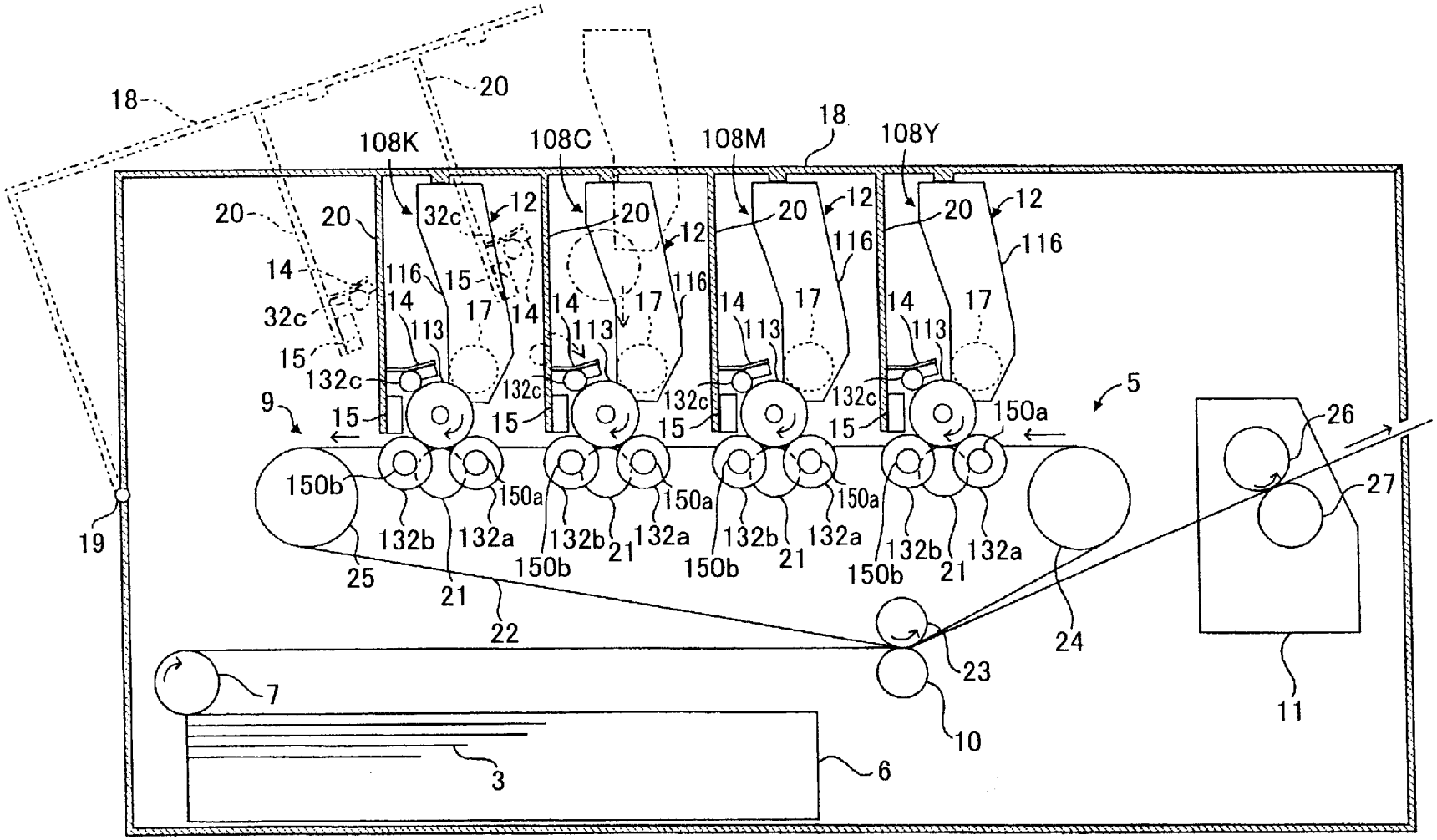
FIG. 3 is a cross-sectional visa showing essential components of a color laser printer according to a second embodiment of the present invention, wherein the photosensitive drum is supported by three support rollers.

Next, a color laser printer 100 according to a second embodiment of the present invention will be described with reference to FIGS. 3 and 4. The color laser printer 100 includes a plurality of process portions 108 that correspond to the process portions 8 of the first embodiment. Each process portion 106 includes three support rollers 132, that is, first through third support rollers 132*a*, 132*b*, and 132*c*, at each axial end of each photosensitive drum 113. As in the first embodiment, the process portions 108 have substantially the same configuration and surrounding components, so the configuration of the cyan developing process portion 108C and surrounding components will be described as a representative example.

Figure 4:
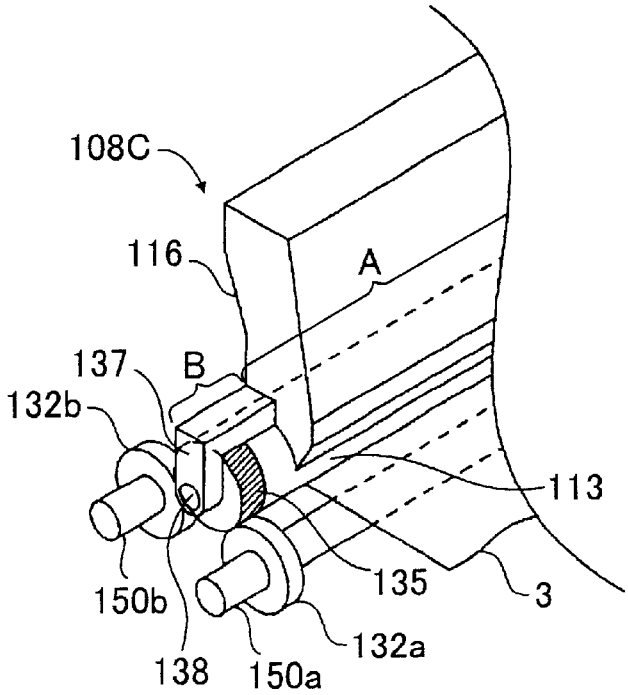
FIG. 4 is a perspective view showing components around one axial end of the cyan developing process portion of the color laser printer of FIG. 3, wherein the surface of photosensitive drum that contacts a support roller is formed with a fluoride resin coating.

As shown in FIG. 4, the support rollers 132 support the photosensitive drum 113 at a non-image forming region B at the axial end of the photosensitive drum 113. The first and second support rollers 132*a*, 132*b* support the photosensitive drum 113 by abutment from below and the third support roller 132*c* supports the photosensitive drum 113 by abutment from above. An attachment member 137 connects the development cartridge 116 to the axial end of the drum shaft of the photosensitive drum 113.

The first and second support rollers 132*a*, 132*b* are disposed in confrontation with each other separated by a predetermined distance on either side of the primary transfer roller 21. The first end second support rollers 132*x*, 132*b* have roller shafts 150*a*, 150*b*, respectively. The roller shafts 150*a*, 150*b* extend parallel with the axial direction of the photosensitive drum 113 and are rotatably supported on the casing 2 so that the first and second support rollers 132*a*, 132*b* are fixed in a condition of being slidably abutting against the photosensitive drum 113 from below.

The third support roller 132*c* is provided on the attachment frame 20 of the cover 18 so as swing integrally with the cover 18 in the same manner as the stopper member 31. When the process cartridge 12 needs to be removed, the third support roller 132*c* is swung with the cover 18 in the direction for separating the third support roller 132*c* from the photosensitive drum 113. Once the process cartridge 12 is mounted, then the third support roller 132*c* is swung with the cover 18 into sliding and pressing abutment with the axial end of the photosensitive drum 113 from above. With this configuration, the third support roller 132*c* is freely detachable with respect to the photosensitive drum 113. According to the second embodiment, the photosensitive drum 113 when in a mounted condition is supported at three positions by the three support rollers 132*a*, 132*b*, 132*c*, that is, at two position from below by sliding abutment with the first and second support rollers 132*a*, 132*b* and at one position from above by swingable pressing abutment from the third support roller 132*c*.

The photosensitive drum 113 is supported at three positions by the three support rollers 132*a*, 132*b*, 132*c* so as to be rotatable at two positions at its outer peripheral surface by the first and second support rollers 132*a*, 132*b*, which are fixed to the casing, and also at one position at its outer peripheral surface by the third support roller 132*c*. Therefore, smooth rotation of the photosensitive drum 113 is insured and the photosensitive drum 113 can be reliably and simply positioned. For this reason, eccentric rotation of the photosensitive drum 113 can be even more reliably prevented and proper image formation can be achieved.

As shown in FIG. 4, the photosensitive drum 113 contacts the support rollers 132*a*, 132*b*, 132*c* at a contact surface 135 where the support rollers 132*a*, 132*b*, 132*c* support the photosensitive drum 113 around the periphery of the axial end of the photosensitive drum 113. It is desirable that the contact surface 135 be coated with a fluoroplastic material, for example, a fluoride resin coating. Sliding resistance between the support rollers 132*a*, 132*b*, 132*c* and the photosensitive drum 113 can be reduced by providing the fluoride resin coating at the contact surface 135 where the photosensitive drum 113 is contacted by the support rollers 132*a*, 132*b*, 132*c*. The photosensitive drum 113 can be smoothly and accurately rotated so that proper images can be formed. It should be noted that a fluoride resin coating can be applied to the surface of the support rollers 132*a*, 132*b*, 132*c* that contact the photosensitive drum 113 instead of or in addition to providing a fluoride resin coated to the contact surface 35 of the photosensitive drum 113.

Figure 5:
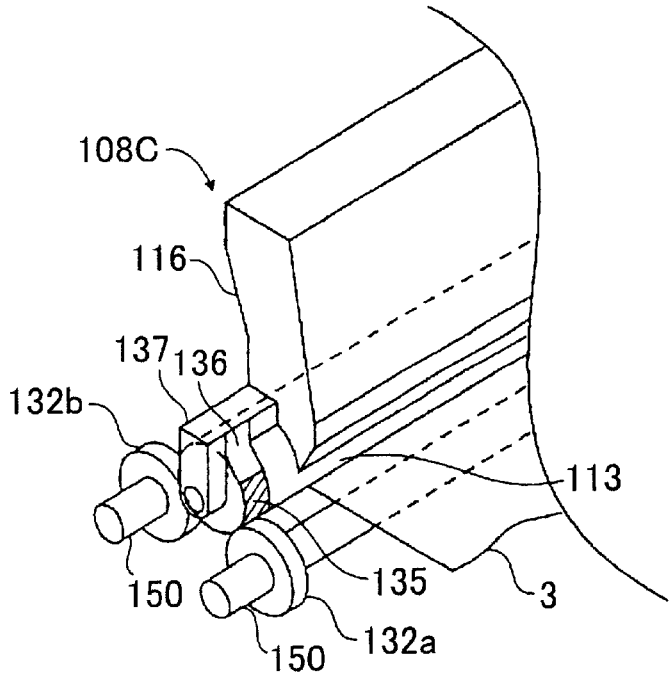
FIG. 5 is a perspective view showing a modification of the configuration shown in FIG. 4, wherein a cleaning film is provided on the surface where the photosensitive drum contacts the support roller.

FIG. 5 shows a modification of the second embodiment. According to the second embodiment, a cleaning film 136 is provided for cleaning the contact surface 135 of the photosensitive drum 113. The cleaning film 136 is a rectangular film attached to the attachment member 137. The cleaning film 136 is disposed in contact with the contact surface 135 at the outer peripheral surface at the axial end of the photosensitive drum 113. The cleaning film 136 scrapes off toner that clings to the surface of the photosensitive drum 113 where the cleaning film 136 contacts the rotating photosensitive drum 113. It should be noted that the cleaning film could instead or also be provided in contact with the outer peripheral surfaces of the support rollers 132*a*, 132*b*, 132*c* 132*a* to clean the contact surface of the support rollers 132*a*, 132*b*, 132*c* 132*a*.

For example, while images are being formed, toner and the like can drift around and cling to the contact surface of the photosensitive drum 113. This clinging toner can enter between the photosensitive drum 113 and the support rollers 132*a*, 132*b*, 132*c* and obstruct smooth rotation of the photosensitive drum 113. However, because the cleaning film 136 is provided for cleaning the contact surface 135, the contact surface 135 of the rotating photosensitive drum 113 is constantly cleaned by the cleaning film 136. Therefore, no problems will result from clinging toner, so that stable rotation of the photosensitive drum 113 can always be secured and proper images can be formed.

In both the second embodiment and its modification, the photosensitive drum 113 is rotatably supported by the three support rollers 132*a*, 132*b*, 132*c* at the non-image forming region B of the outer peripheral surface of the photosensitive drum 113. Therefore, images can be properly and smoothly formed on the image forming region A of the photosensitive drum 113 without any obstruction from the support roller 32.

Next, a color laser printer 200 according to a third embodiment of the present invention will be described while referring to FIGS. 6 and 7. In the third embodiment, the three pairs of first and second support rollers 132*a*, 132*b* that are disposed between the adjacent photosensitive drums 113 in the second embodiment are replaced shared rollers 238*a*, 238*b*, 238*c*. That is, a single shared roller 238*a*, 238*b*, or 238*c* is used instead of a pair of adjacent support rollers 132*a*, 132*b*. Each process portion 208*k*, 208C, 208M, and 208Y of the color laser printer 200 has substantially the same configuration and surrounding components as the cyan developing process portion 208C and surrounding components shown in FIG. 7.

According to the third embodiment, a ring-shaped bearing member 241 is fitted to the outer peripheral surface in a non-image forming region at the axial end of each photosensitive drum 213. The shared rollers 238*a*, 238*b*, 238*c* are disposed in sliding abutment with the bearings 241 of the photosensitive drums 213 at a position between adjacent photosensitive drums 213. The shared rollers 238*a*, 238*b*, 238*c* each have a rotation shaft 350 that extends in parallel with the axial direction of the photosensitive drum 213. The rotational shafts 350 are fixed to the casing 2 so that the shared rollers 238*a*, 238*b*, 238*c* are rotatable.

Figure 7:
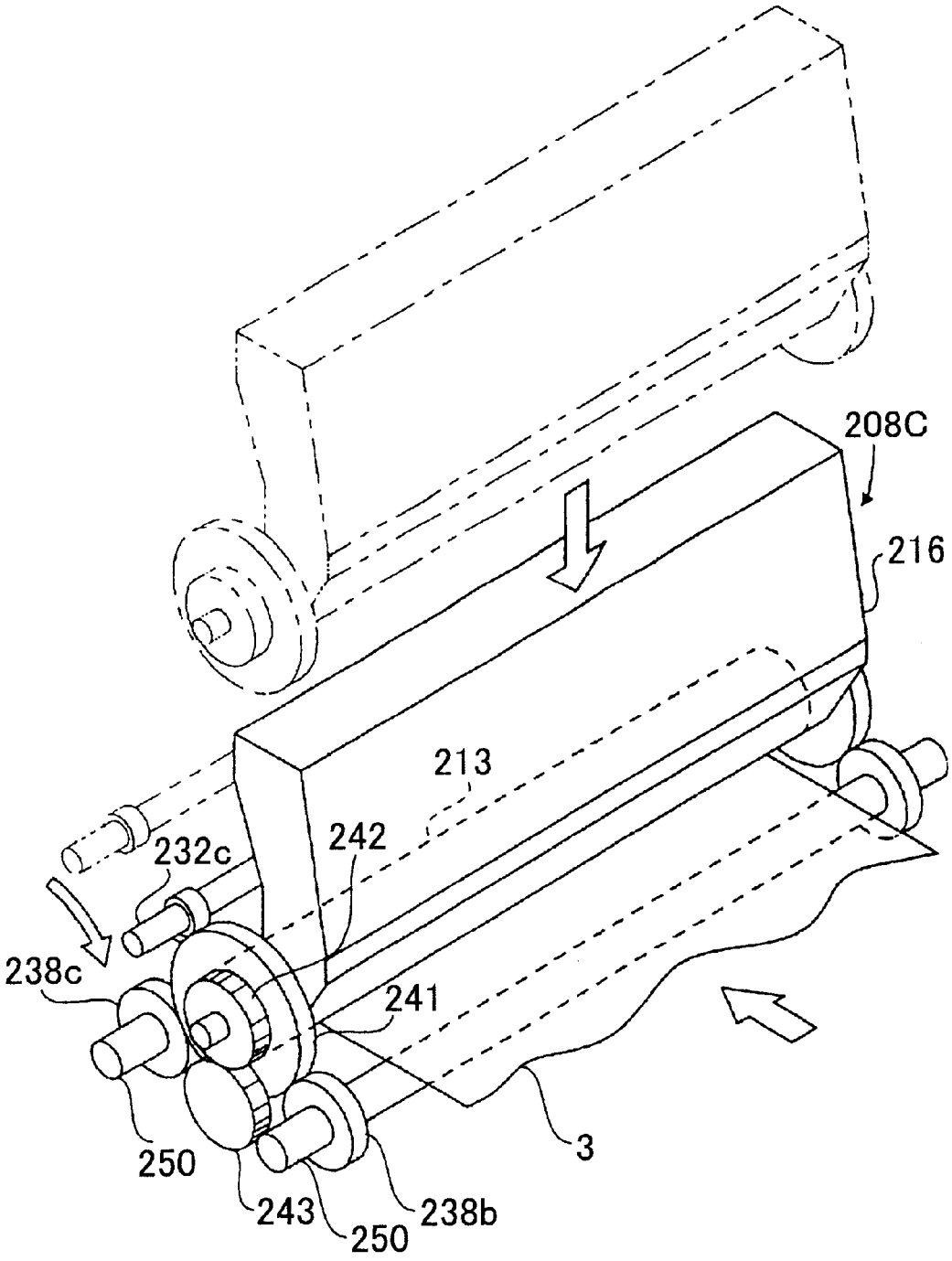
FIG. 7 is a perspective view showing components of the cyan developing process portion of the color laser printer of FIG. 6.

As shown in the example of FIG. 7, a gear 242 is formed at the outer peripheral surface of each photosensitive drum 213 at a position further to the outside in the axial direction of the photosensitive drum 213 than the bearing member 241. Although not shown in the drawings, a power source is provided for driving rotation of the gear 242 via a transmission gear 243.

The first shared roller 238*a* in disposed between the photosensitive drum 213 of the yellow developing process portion 308Y and the photosensitive drum 213 of the magenta developing process, portion 308M. The first shared roller 238*a* supports these two photosensitive drums 213 in a rotatable condition through the bearings 341. The second shared roller 238*b* is disposed between the photosensitive drum 213 of the magenta developing process portion 308M and the photosensitive drum 213 of the cyan developing process portion 308C. The second shared roller 238*b* supports these two photosensitive drums 213 in a rotatable condition through the bearings 341. The third charod roller 230*c* is disposed between the photosensitive drum 213 of the cyan developing process portion 308C and the photosensitive drum 213 of the black developing process portion 308M. The third shared roller 238*c* supports these two photosensitive drums 213 in a rotatable condition through the bearings 341.

Figure 6:
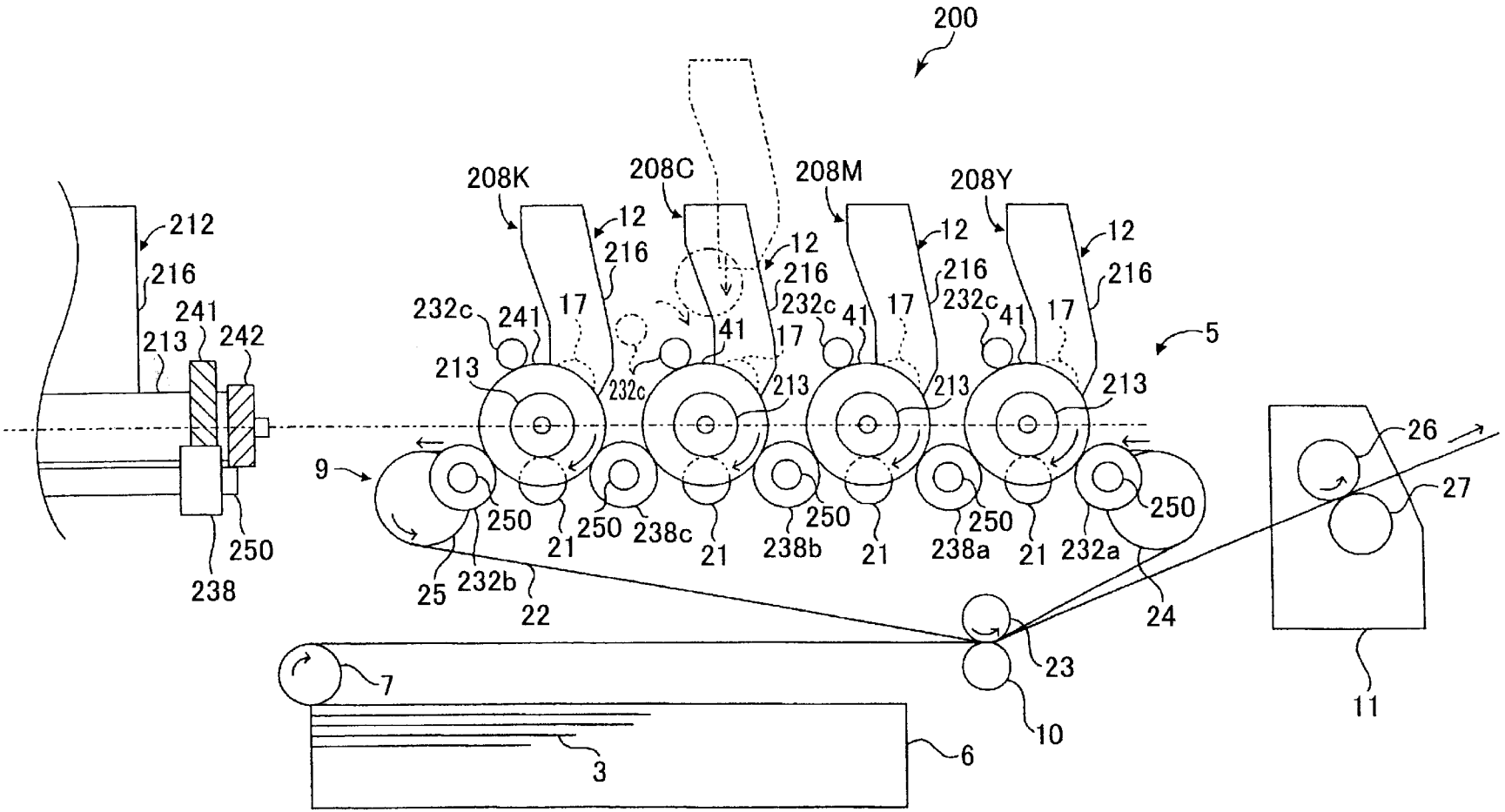
FIG. 6 is a schematic side view showing a color laser printer according to a third embodiment of the present invention, wherein adjacent photosensitive drums are positioned and supported by shared rollers.

As shown in FIG. 6, first, second, and third support rollers 232*a*, 232*b*, and 232*c* are provided so that all the photosensitive drums 213 are supported at three positions in cooperation with the shared rollers 238*a*, 238*b*, and 238*c*. That is, the first support roller 232*a* is provided at a position upstream from and below the photosensitive drum 213 of the yellow developing process portion 208Y in sliding abutment with the bearing 241 of the photosensitive drum 213 of the yellow developing process portion 208Y in order to support the photosensitive drum 213 of the yellow developing process portion 208Y. The second support roller 232*b* is provided at a position downstream from and below the photosensitive drum 213 of the black developing process portion 206B in sliding abutment with the bearing 241 of the photosensitive drum 213 of the black developing process portion 208B in order to support the photosensitive drum 213 of the black developing process portion 208B. The third support rollers 232*c* are provided above corresponding photosensitive drums 213 so as to be freely detachable with respect to the bearing 241 of the corresponding photosensitive drum 213.

In this way, each two adjacent photosensitive drums 213 are supported by a single one of the shared rollers 238*a*, 238*b*, 238*c* so that the two adjacent photosensitive drums 213 can be positioned by the single one of the shared rollers 238*a*, 238*b*, 238*c*. Therefore, fewer parts are required and the precision of the pitch between the photosensitive drums 213 is enhanced compared to the second embodiment, wherein each photosensitive drum is supported by both a first and second roller 132*a*, 132*b*. For this reason, images can be formed even better.

According to the third embodiment, each photosensitive drum 213 is rotatably supported, via the bearing member 241, at three positions by three rollers at the outer peripheral surface of each axial end. That is, the photosensitive drum 213 of the yellow developing process portion 308Y is supported by the first support roller 232*a*, the first shared roller 238*a*, and one of the third support rollers 232*c*. The photosensitive drum 213 of the magenta developing process portion 308M is supported by the first shared roller 238*a*, the second shared roller 238*b*, and another one of the third support rollers 232*c*. The photosensitive drum 213 Of the cyan developing process portion 308C is supported by the second shared roller 238*b*, the third shared roller 238*c*, and another one of the third support rollers 232*c*. The photosensitive drum 213 of the black developing process portion 308B is supported by the third shared roller 238*c*, the second support roller 232*b*, and another one of the third support rollers 232*c*. Therefore, the photosensitive drum 213 can be accurately positioned and reliably rotated with a simple configuration. As a result, eccentric rotation of the photosensitive drum 213 can be reliably prevented and proper images can be formed.

Figure 8:
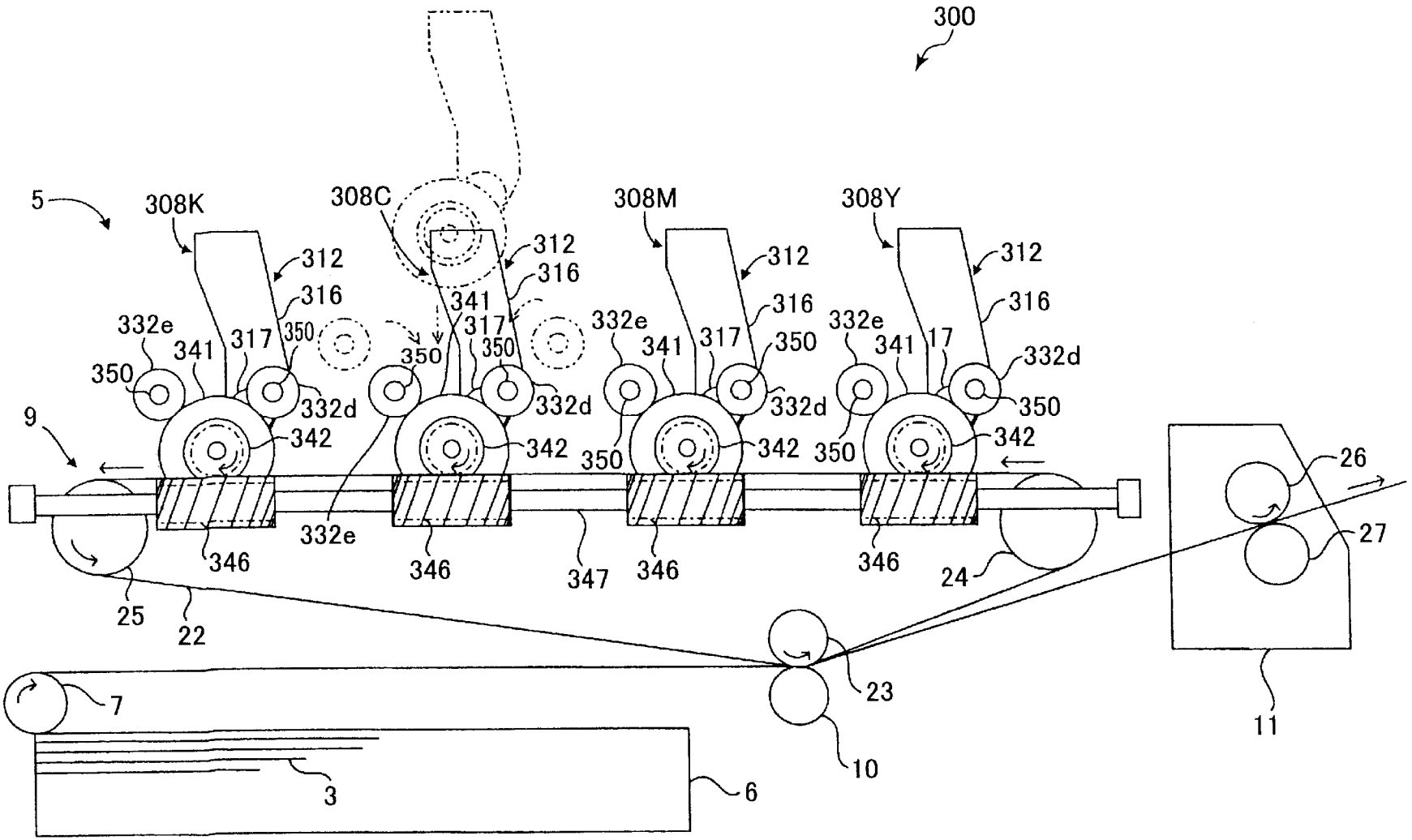
FIG. 8 is a schematic side view showing a color laser printer according to a fourth embodiment of the present invention, wherein the photosensitive drum is supported by a worm gear and two support rollers.
Figure 9:
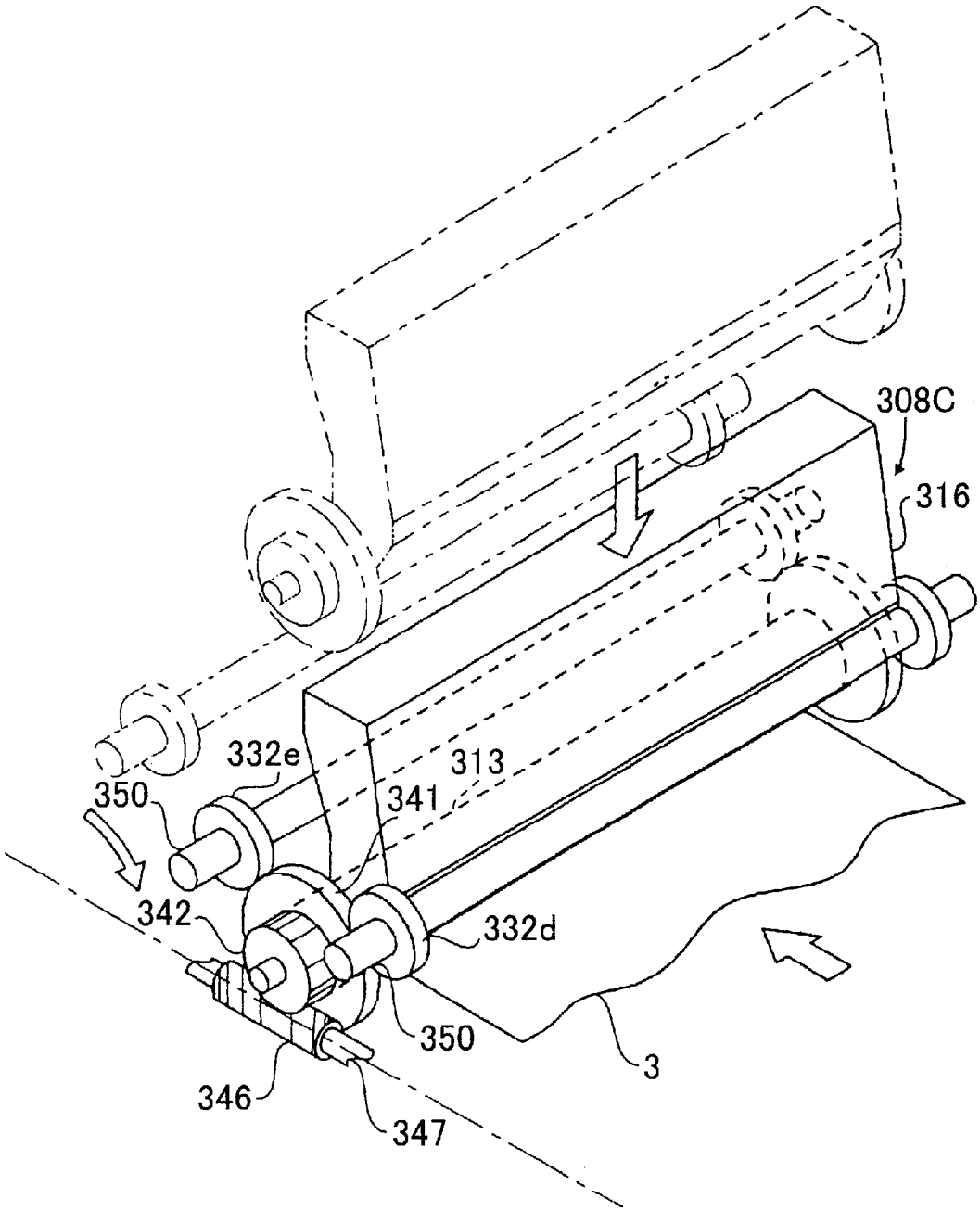
FIG. 9 is a perspective view showing components of the cyan developing process portion of the color laser, printer of FIG. 8.

Next, a color laser printer 300 according to a fourth embodiment will be described with reference to FIGS. 8 and 9. According to the fourth embodiment, photosensitive drums 313 of process portions 308*k*, 308C, 308M, and 308Y are each supported by a corresponding worm gear 346 and two support rollers 332*d* and 332*e*. The process portions 308*k*, 308C, 308M, and 308Y each have substantially the same configuration and surrounding components as the cyan developing process portion 308C and surrounding components shown in FIG. 9. Although not shown in the drawings, the and of the photosensitive drum 313 opposite from the single drive shaft 347 and the two support rollers 332*d* and 332*e* is supported on the frame, for example by the L-shaped member 30 and the stopper member 31 of the first embodiment.

According to the fourth embodiment, a bearing member 341 having a ring shape is fitted on the outer peripheral surface at the non-image forming region at the axial end of each photosensitive drum 313. A gear 342 is formed integrally to the axial end of each photosensitive drum 313 at a position farther out than the bearing 341 with respect to the axial direction of the photosensitive drum 314. The gears 342 are worm wheels that are meshingly engagable with the worm gear 346.

A single drive shaft 347 extends following the movement direction of the endless belt 22. The worm gears 346 are formed integrally on a drive shaft 347 in confrontation with the gear 432 of the corresponding photosensitive drum 313. The worm gears 346 are oriented perpendicular with the axial direction of the photosensitive drums 313 while in a meshingly engaged condition with the gear 342 of the corresponding photosensitive drum 313. The single drive shaft 347 drives rotation of all the worm gears 346. Although not shown in the drawings, a drive source and transmission mechanism is provided for transmitting drive force to the drive shaft 347.

The fourth and fifth support rollers 332*d* and 332*e* are disposed above the bearing 341, separated by a predetermined distance. The fourth and fifth support rollers 332*d* and 332*e* are provided on the attachment frame 20 of the cover 18 in the same manner as the stopper member 31. When a process cartridge 312 is to be removed, the cover 18 is swung open so that the fourth and fifth support rollers 332*d* and 332*e* swing in the direction for separating them from the photosensitive drums 313. Once the process cartridge 312 is mounted, the cover 16 is swung closed to that the fourth and fifth support rollers 332*d* and 332*e* slidingly press against the axial end of the photosensitive drums 313 from above separated from each other by a predetermined distance.

With this configuration, the fourth and fifth support rollers 332*d* and 332*e* are freely detachable with respect to the photosensitive drums 313. According to the fourth embodiment, the photosensitive drums 313 are each supported at three positions by the corresponding single worm gear 346 and two support rollers 332*d* and 332*e*, that is, the photosensitive drums 313 are each supported at their axial end at one position from below by the worm gear 346 and at two positions from above by the pressure from the swingable fourth and fifth support rollers 332*d* and 332*e*.

When the drive force from the drive source (not shown) is transmitted to the drive shaft 347, then the worm gears 346 formed integrally with the drive shaft 347 are driven to rotate. As a result, the photosensitive drums 313 are driven to rotate via the gears 342, which are in meshing engagement with the worm gears 346.

In this way, each photosensitive drum 313 is supported by the drive shaft 347 and the corresponding two support rollers 332*d* and 332*e*, that is, at one position at the outer peripheral surface of the photosensitive drums 313 by abutment with the worm gear 346 and at two positions at the outer peripheral surface of the photosensitive drums 313 by abutment with the fourth and fifth support rollers 332*d* and 332*e* provided on the cover 18. As a result, the photosensitive drums 313 can be reliably positioned and supported using a simple operation. Eccentric rotation of the photosensitive drum 313 can be prevented and good-quality images can be formed.

The worm gears 346, which are in meshing engagement with the gears 442 of the photosensitive drums 313, serve both as a gear for transmitting drive and as a support member of the photosensitive drum 313. Therefore, fewer components are required. As a result, configuration is simpler and costs can be reduced.

Further, according to the fourth embodiment, the worm gear 346 for driving the photosensitive drum 313 is provided on a single drive shaft 347, which extends perpendicular with the axial direction of the photosensitive drum 313. Therefore, the single drive shaft 347 can be driven by a single drive source. As a result, the photosensitive drums 313 can be driven without providing a gear train transmission mechanism or a separate drive source for each photosensitive drum 313. For this reason, the photosensitive drums photosensitive drum 313 can be reliably driven by a simple configuration.

While the invention has been described in detail with reference to specific embodiments thereof, it would be apparent to those skilled in the art that various changes and modifications may be made therein without departing from the spirit of the invention, the scope of which is defined by the attached claims.

For example, the embodiments describe the present invention applied to color laser printers with a intermediate transfer mechanism 9, wherein visible images for each color are borne on separate photosensitive drums and transferred to the endless belt 22 one at a time in order to form a full color image on the endless belt 22. Then, the full color image is transferred at one time onto the sheet by a secondary transfer roller 10. However, there is no need to provide the intermediate transfer mechanism 9. That is, depending on the objective and use of the color laser printer, the visible color images borne on the different photosensitive drums 13 can be transferred directly onto the sheet 3 one at a time by the primary transfer Collar 21 to form a full color image on the sheet 3.

Also, the configurations according to the present invention for supporting a photosensitive drum can be applied to a monochrome laser printer just as effectively as to a full color printer.

Also, the embodiments described the photosensitive drum as being supported at three positions. However, the effects of the present invention can be achieved if the photosensitive drum is supported at four or more positions.

The ring-shaped bearing member 241 of the third embodiment could also be provided around the outer peripheral surface of the photosensitive drum 113 of the second embodiment.

What is claimed is:

1. An image forming device, comprising:

a photosensitive body that has an outer peripheral surface; and a support that supports the photosensitive body in a rotatable condition by supporting the outer peripheral surface of the photosensitive body, wherein the support supports the photosensitive body at at least three positions at the outer peripheral surface of the photosensitive body, and the support includes:

a substantially L-shaped first support member that supports the outer peripheral surface of the photosensitive body at at least two positions, and a second support member that supports the outer peripheral surface of the photosensitive body at at least one position.

2. An image forming device as claimed in claim 1, further comprising a bearing provided at the outer peripheral surface of the photosensitive body, the first support member and the second support member supporting the outer peripheral surface of the photosensitive body through the bearing.

3. An image forming device, comprising:

a photosensitive body that has an outer peripheral surface;

a support that supports the photosensitive body in a rotatable condition by supporting the outer peripheral surface of the photosensitive body, wherein the support supports the photosensitive body at at least three positions at the outer peripheral surface of the photosensitive body, and the support includes at least three rollers for supporting the outer peripheral surface of the photosensitive body; and another photosensitive body adjacent to the photosensitive body, the at least three rollers including a shared roller for positioning the adjacent photosensitive bodies.

4. An image forming device as claimed in claims 3, further comprising a bearing at the outer peripheral surface of the photosensitive body, the roller members supporting the outer peripheral surface of the photosensitive body through the bearing.

5. An image forming device, comprising:

a photosensitive body that has an outer peripheral surface; and a support that supports the photosensitive body in a rotatable condition supporting the outer peripheral surface of the photosensitive body, wherein the support and the photosensitive body have contact surfaces where the support contacts and supports the outer peripheral surface of the photosensitive body, the contact surface of at least one of the support and the photosensitive body being coated with a fluoroplastic material.

6. An image forming device as claimed in claim 5, wherein the support supports the outer peripheral surface of the photosensitive body at a non-image forming region.

7. An image forming device as claimed in claim 6, wherein the photosensitive body has a cylindrical drum shape with an outer circumferential surface, an image forming region being located around the axial central portion of the outer circumferential surface, the non-image forming region being located at both axial ends of the outer circumferential surface outside from the image forming region.

8. An image forming device as claimed in claim 5, wherein the support and the photosensitive body have contact surfaces where the support contacts and supports the outer peripheral surface of the photosensitive body, and further comprising a cleaning member for cleaning at least one of the contact surfaces of the support and the photosensitive body.

9. An image forming device as claimed in claim 5, further comprising a plurality of photosensitive bodies for forming different color images.

* * * * *